US011117794B2

(12) United States Patent
Candido De Lima Junior et al.

(10) Patent No.: US 11,117,794 B2
(45) Date of Patent: Sep. 14, 2021

(54) LIQUID POURING CONTROL

(71) Applicant: International Business Machines Corporation, Armonk, NY (US)

(72) Inventors: Juscelino Candido De Lima Junior, Campinas (BR); Jose Gilberto Biondo Junior, Valinhos (BR); Leoni Murilo Lima, Campinas (BR); Ivan Francisco Franco, Valinhos (BR); Igor Monteiro Vieira, Hortolandia (BR)

(73) Assignee: International Business Machines Corporation, Armonk, NY (US)

( * ) Notice: Subject to any disclaimer, the term of this patent is extended or adjusted under 35 U.S.C. 154(b) by 113 days.

(21) Appl. No.: 16/686,260

(22) Filed: Nov. 18, 2019

(65) Prior Publication Data

US 2021/0147210 A1 May 20, 2021

(51) Int. Cl.
*B67D 1/12* (2006.01)
*B67D 1/08* (2006.01)

(52) U.S. Cl.
CPC ..... *B67D 1/1238* (2013.01); *B67D 1/0888* (2013.01); *B67D 1/124* (2013.01); *B67D 1/1236* (2013.01); *B67D 2001/1263* (2013.01); *B67D 2210/00083* (2013.01)

(58) Field of Classification Search
CPC .... B67D 1/088; B67D 1/1236; B67D 1/1238; B67D 1/124; B67D 2001/1263
See application file for complete search history.

(56) References Cited

U.S. PATENT DOCUMENTS 5,491,333 A * 2/1996 Skell ..... G01F 23/2921 250/222.1
8,109,301 B1 * 2/2012 Denise ..... G07F 9/023 141/360
9,679,329 B2 6/2017 Jones
2011/0017776 A1 * 1/2011 Metropulos ..... B67D 1/0888 222/129.1
2013/0048668 A1 2/2013 Osborne
(Continued)

FOREIGN PATENT DOCUMENTS

CA 2507459 C 11/2011
DE 10239595 B4 2/2006

OTHER PUBLICATIONS

"Automic bottle filling machine", COMAC, Printed Aug. 29, 2019, 3 pages, <https://www.comacgroup.com/comac/focus/automatic-bottle-filling-machine>.

(Continued)

*Primary Examiner* — Timothy P. Kelly
(74) *Attorney, Agent, or Firm* — Sonny Z. Zhan

(57) ABSTRACT

In an approach for pouring control, a processor recognizes that a user requests material from a dispenser with a container. A processor evaluates the container via one or more sensors. A processor determines that the user is allowed to receive the material. A processor, in response to determining that the user is allowed to receive the material, triggers the dispenser to pour the material into the container. A processor monitors the dispenser pouring the material. A processor determines that an anomaly is detected during pouring the material. A processor, in response to determining that the anomaly is detected during pouring the material, signals the dispenser to stop the pouring.

17 Claims, 9 Drawing Sheets

(56) References Cited

U.S. PATENT DOCUMENTS

| | | | | |
|---|---|---|---|---|
| 2014/0091935 | A1 | 4/2014 | Rosenfeld | |
| 2020/0247662 | A1 * | 8/2020 | Wade | B67D 1/0877 |

OTHER PUBLICATIONS

"CleanFLEX, the ultrasonic fill-level sensor", ECube Labs, Printed Nov. 5, 2019, 10 pages, <https://www.ecubelabs.com/ultrasonic-fill-level-sensor/>.

"Made-In-China: Connecting Buyers with Chinese Suppliers", Zhangjiagang Reliable Machinery Co., Ltd., Printed Nov. 5, 2019, 6 pages, <https://reliable-machinery.en.made-in-china.com/?gclid-CjwKCAjwq-TmBRBdEiwAaO1en6ZwJ8A8j1hREOfGjiJ9r-p6VA_FzcAdQNQtV_c9Dh5elfybk6jM_xoCriYQAvD_BwE>.

Le, Amy, "Ultrasonic Sensing Basics for Liquid Level Sensing, Flow Sensing, and Fluid Identification Applications", Texas Instruments Application Report, SNAA 220A, Mar. 2015,10 pages, <http://www.ti.com/lit/an/snaa220a/snaa220a.pdf>.

Mell et al., "The NIST Definition of Cloud Computing", Recommendations of the National Institute of Standards and Technology, Special Publication 800-145, Sep. 2011, 7 pages.

Schenck et al., "Visual Closed-Loop Control for Pouring Liquids", Printed Aug. 29, 2019, 8 pages, <https://rse-lab.cs.washington.edu/papers/closed-loop-pouring-icra-17.pdf>.

* cited by examiner

LIQUID POURING CONTROL

BACKGROUND

The present disclosure relates generally to the field of liquid dispensing, and more particularly to detecting container types and borders for a dispenser to fill the container with liquid properly.

A water dispenser is a device that dispenses water. It is used to provide easy access to drinking water. A water dispenser can be useful in many situations. Some offices prefer to have a water dispenser because it provides clients and employees with convenient access to water, without having to take extended breaks or drive to the store. A soda fountain is a device that dispenses carbonated soft drinks. A soda fountain can be found in restaurants, concession stands and other locations such as convenience stores. A vending machine is an automated machine that provides items such as snacks, beverages, cigarettes and lottery tickets to consumers.

SUMMARY

Aspects of an embodiment of the present disclosure disclose an approach for pouring control. A processor recognizes that a user requests material from a dispenser with a container. A processor evaluates the container via one or more sensors. A processor determines that the user is allowed to receive the material. A processor, in response to determining that the user is allowed to receive the material, triggers the dispenser to pour the material into the container. A processor monitors the dispenser pouring the material. A processor determines that an anomaly is detected during pouring the material. A processor, in response to determining that the anomaly is detected during pouring the material, signals the dispenser to stop the pouring.

DETAILED DESCRIPTION

The present disclosure is directed to systems and methods for detecting container types and borders for a dispenser to fill the container with liquid properly.

The present disclosure recognizes that many liquid-filling solutions are based on pre-defined values. Those values are a limitation since no other vessels with different sizes can be totally filled without extra effort. Recipients that are thinner than the smallest available of pre-defined values would suffer from overflows or require a manual human interaction to stop the filling before the overflow happens. With the advance of all-in-one machines for pouring material (e.g., liquid) for users, the present disclosure recognizes a need for techniques to detect types of material (e.g., liquid), recipients (e.g., containers) and users when using the machines.

The present disclosure discloses a system to scan a recipient and detect characteristics (e.g., size, thickness, type) of the recipient. Based on the recipient, the system will not only be able to detect the limitation of the recipient, but also be able to deny or allow a particular type of liquid to be poured based on the recipient in place. For example, if a user places a thin plastic recipient and requests boiling water, the system will deny the pouring of the boiling water based on the claim the recipient will not safely hold the boiling water. The system can pause the pouring if the recipient cracks or a rupture is identified. In another embodiment, the system can match a user profile and the liquid that is allowed to be poured.

The present disclosure discloses a system including a sub-set of detection sensors. The detection sensors, for example, can be infrared cameras, infrared dot projectors, and ultrasonic sensors. The system may receive a telemetry gathered from the detection sensors and the detection sensors can be connected with a database of liquid/recipient characteristics. The present disclosure further discloses a decision-based mechanism that is leveraged to authorize if the user and/or the recipient are granted to receive the liquid. The system may analyze the stream data and detect the recipient. Once the user inputs the type of liquid to be poured, the system may search the database of recipients and make a decision on rather or not the liquid can be poured.

Figure 1:
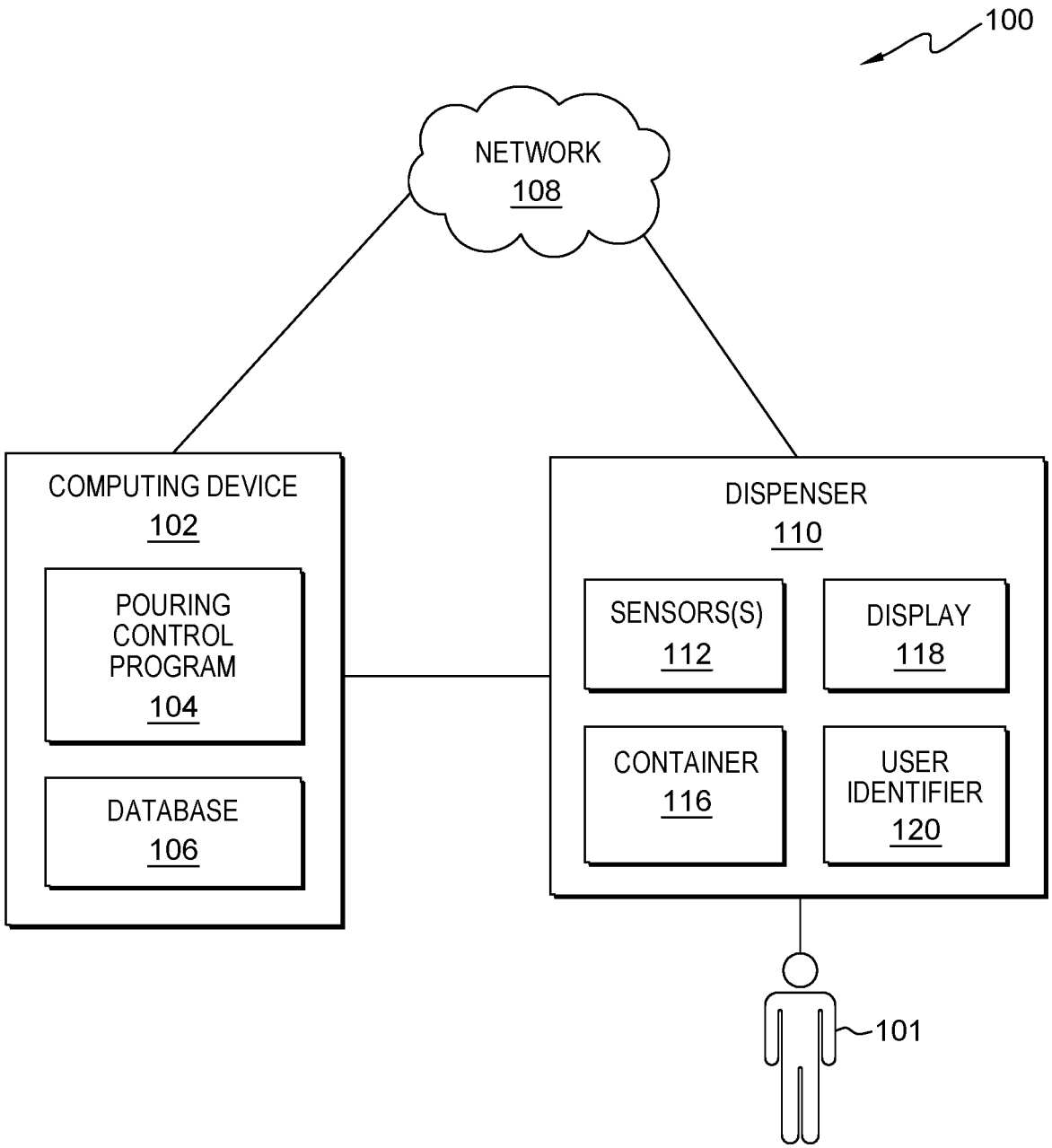
FIG. 1 is a functional block diagram illustrating a pouring control environment, in accordance with an embodiment of the present disclosure.

The present disclosure will now be described in detail with reference to the Figures. FIG. 1 is a functional block diagram illustrating a pouring control environment, generally designated 100, in accordance with an embodiment of the present disclosure.

In the depicted embodiment, pouring control environment 100 includes computing device 102, dispenser 110, and network 108.

In various embodiments of the present disclosure, dispenser 110 can be a device that is designed to release a specific amount of material (e.g., liquid) for user 101. For example, dispenser 110 can be a water dispenser, a soda fountain, a vending machine, or other suitable machines that can dispense material for user 101. The material, for example, can be water, beverages, wines, and or any other liquid. In another example, the material can be solid material such as sugar, salt, cereals, and any other suitable material that can be released from dispenser 110 for user 101. In one or more embodiments, dispenser 110 may be accessed through a communication network such as network 108. The communication network can be, for example, a local area network (LAN), a wide area network (WAN) such as the Internet, or a combination of the two, and may include wired, wireless, fiber optic or any other connection known in the art. In other embodiments, dispenser 110 may be connected and accessed through computing device 102 in a wired, wireless, fiber optic or any other connection known in the art.

Further, in the depicted embodiment, dispenser 110 includes sensor(s) 112, display 118, and user identifier 120. Dispenser 110 may include container 116 that user 101 puts into dispenser 110 to request material from dispenser 110. Container 116 can be a glass, a cup, or any other suitable container to receive material from dispenser 110. In one or more embodiments, display 118 displays information associated with dispenser 110 when user 101 requests material from dispenser 110. For example, display 118 may display choices of material for user 101. Display 118 may display instructions and messages for user 101. In another example, display 118 may be a touch screen that detects user touch and serves as input interface for user 101.

In one or more embodiments, sensor(s) 112 may include a projector, a camera, an ultrasonic sensor, and a weight sensor. The projector may project lights over the surface of container 116. In an example, the projector is an infrared dot projector that projects infrared dots over the surface of container 116. In another example, the projector can be any other sensor that may project lights (visible and or invisible) over the surface of container 116. The camera can capture images of the surface of container 116. In an example, the camera is an infrared camera that can capture the surface of container 116 with the infrared dots. In another example, the camera can be an optical camera or any other sensor that captures images of the surface of container 116. The ultrasonic sensor is configured to evaluate, for example, component and thickness of container 116, in order to decide what types of material can be poured into container 116. The ultrasonic sensor may evaluate container 116 by ascertaining characteristics of container 116 including size, volume, component, and condition of container 116. The weight sensor is configured to identify any leakage not identified by other sensors, and or if container 116 is removed during the filling process. In an example, sensor(s) 112 may be detection sensors that are fixed in dispenser 110 mounted on the base of a nozzle in dispenser 110. Sensor(s) 112 may be connected and in communication with database 106 which stores characteristics information of material and containers for dispenser 110.

In one or more embodiments, user identifier 120 is configured to identify user 101 to use dispenser 110. User 101 can disable this feature or have to opt in to have their identification information be obtained. User 101 is in control of what type of information is going to be collected and aware of how that information is going to be used. In an embodiment, user 101 is notified when the data collection of user 101 identification information is being collected. In another example, user 101 can easily select the use of one of identification information of user 101 but can dis-allow the use of other identification information of user 101. User identification information is detected by user identifier 120 for user 101. User identification can be achieved by several different methods, including, but not limited to, user identity and password, digital fingerprint, face recognition, near field communication, biometric recognition, and other suitable user identification method by user identifier. In another example, a fingerprint reader may be used as another embodiment to user identification and authentication for using dispenser 110.

In various embodiments of the present disclosure, computing device 102 can be a laptop computer, a tablet computer, a netbook computer, a personal computer (PC), a desktop computer, a mobile phone, a smartphone, a smart watch, a wearable computing device, a personal digital assistant (PDA), or a server. In another embodiment, computing device 102 represents a computing system utilizing clustered computers and components to act as a single pool of seamless resources. In other embodiments, computing device 102 may represent a server computing system utilizing multiple computers as a server system, such as in a cloud computing environment. In general, computing device 102 can be any computing device or a combination of devices with access to pouring control program 104 and network 108 and is capable of processing program instructions and executing pouring control program 104, in accordance with an embodiment of the present disclosure. Computing device 102 may include internal and external hardware components, as depicted and described in further detail with respect to FIG. 7.

Further, in the depicted embodiment, computing device 102 includes pouring control program 104 and database 106. In the depicted embodiment, pouring control program 104 and database are located on computing device 102. However, in other embodiments, pouring control program 104 and database 106 may be located externally and accessed through a communication network such as network 108. The communication network can be, for example, a local area network (LAN), a wide area network (WAN) such as the Internet, or a combination of the two, and may include wired, wireless, fiber optic or any other connection known in the art. In general, the communication network can be any combination of connections and protocols that will support communications between computing device 102 and pouring control program 104 and database 106, in accordance with a desired embodiment of the disclosure. In another embodiment, pouring control program 104 and database 106 may be located in dispenser 110.

Pouring control program 104 is configured to recognize that user 101 requests material from dispenser 110 with container 116. In an example, the user request may be recognized by dispenser 110 through one or more sensor(s) 112. In another example, the user request may be recognized when user 101 touches display 118. Pouring control program 104 may identify user 101 to use dispenser 110 through user identifier 120. User 101 can disable this feature or have to opt in to have their identification information be obtained. User 101 is in control of what type of information is going to be collected and aware of how that information is going to be used. In an embodiment, user 101 is notified when the data collection of user identification information is being collected. In another example, user 101 can easily select the use of one of identification information of user 101 but can dis-allow the use of other identification information of user 101. User identification information is detected by user identifier 120 for user 101. User identification can be achieved by several different methods, including, but not limited to, user identity and password, digital fingerprint, face recognition, near field communication, and other suitable user identification method by user identifier. In another example, a fingerprint reader may be used as another embodiment to user identification and authentication for using dispenser 110.

Pouring control program 104 may check the recognized user identification against a list of valid users within database 106. If the authentication fails, display 118 in dispenser 110, for example, may not display material options for user. In addition, display 118 may show a message informing user 101 that user 101 is not allowed to receive any material from dispenser 110. If user authentication is successful, pouring control program 104 retrieves a list of material allowed for user 101. Pouring control program 104 may indicate dispenser 110 for ingredients available to create the requested material. User 101 can select the material from the options available.

Pouring control program 104 is configured to evaluate container 116 via one or more of sensor(s) 112. Pouring control program 104 may evaluate container 116 by ascertaining characteristics of container 116 including size, volume, component, and condition of container 116. In an example, the evaluation of container 116 may be performed by sensors 112, including, but not limited to, an infrared dot projector, an infrared camera, an ultrasonic sensor, and a weight scale. The infrared dot projector projects infrared dots over the surface of container 116. The infrared camera captures the surface with the infrared dots. Pouring control program 104 may create a digital version of container 116. Pouring control program 104 may calculate the volume of container 116, and the amount of material that can be poured into container 116 without spilling. Pouring control program 104 may identify possible holes or cracks in container 116, that could cause material to spill, or affect user's 101 ability to use container 116 after container 116 is filled. The ultrasonic sensor and the infrared camera can be used to evaluate the component and thickness of container 116, in order to decide what types of material can be poured into container 116, without compromising the structure of container 116, nor compromising the safety of user 101.

The information collected from sensors 112 available in dispenser 110 may be used by pouring control program 104 to create a three-dimensional model of container 116, calculating the volume and valid material that container 116 can store. The processing by pouring control program 104 can be done either locally, or remotely, when connected to a network accessible server. The results of the evaluation of container 116 may be saved to speed up container recognition when a similar container is used.

In one or more embodiments, pouring control program 104 checks if the material requested is allowed to the type of container 116 placed by user 101. Pouring control program 104 evaluates, for example, the component and thickness of container 116, and the properties of the material to be poured, including, but not limited to, temperature, corrosiveness, and chemical properties of container 116.

If pouring control program 104 determines container 116 fails to match the requirements to receive the material from dispenser 110, display 118 displays a warning message to user 101, identifying the reason why the filling process cannot continue. The filling process can be then halted. If the required conditions for container 116 to receive the material user 101 has requested are met, dispenser 110 starts pouring the material into container 116. During the pouring process, pouring control program 104 continues to monitor container 116 and the material being poured through sensors 112, identifying situations that can compromise the filling process, or a user safety (e.g., over pouring). Pouring control program 104 may monitor through sensors 112 to identify cracks, holes, and or deformations of container 116. Pouring control program 104 may monitor container 116 via sensors 112 to identify any leakage not identified by other sensors, or if container 116 is removed during the filling process. Any errors in the filling process may be logged to database 106 to prevent same or similar conditions that have resulted in error. The filling process is halted when an error happens during the filling process. After the filling process is complete, pouring control program 104 may notify user 101 by display 118 showing a notification message. User 101 can remove container 116 from dispenser 110 when the filling process is complete.

In one or more embodiments, pouring control program 104 may monitor and control through thermal monitoring by sensors 112. For example, pouring control program 104 may extract the three-dimensional information of container 116 and determine the surface border of container 116. During the pouring process, pouring control program 104 may use sensors 112 to monitor and identify variances to the thermal changes of container 116. As the material (e.g., liquid) are poured into container 116, the temperature difference between the liquid and container 116 results in a change in the surface temperature of container 116. This variance results in different wavelengths that will be captured by sensors 112 to determine the liquid level inside container 116. Once sensors 112 detect the liquid has achieved the desired level, pouring control program 104 signals dispenser 110 to stop filling container 116.

In one or more embodiments, pouring control program 104 is configured to determine any anomaly is detected during pouring the material from dispenser 110. In response to determining that an anomaly is detected during pouring the material, pouring control program 104 signals dispenser 110 to stop the pouring. For example, pouring control program 104 may trigger to monitor and detect anomalies after the pouring process is started. In an example, the surface of container 116 may be evenly heated for a period of time. A typical source of heat can be the power of a light. The heat may last for milliseconds of a high thermal conductivity of the material to few seconds for low material conductivity. The thermal pulse delivered in the first stage propagates inside container 116 and is reflected by inclusions or material with thermal properties that container 116 contains. During propagation of the excited jumps, sensors 112 can scan the surface of container 116, recording a sequence of images of container 116. The sequence of images may represent the thermal distribution of the surface as a function of time. The sequence of images can have, for example, 200-500 recordings. Pouring control program 104 analyzes the sequence of images to extract shape defects, depth, edge defects and surface of container 116. In general, the analysis can be explained as defects, inclusions or removal of material properties from container 116. While the thermal pulse is propagated, the temperature rates decay in defective or undamaged areas of the vessel, identifying that there is a difference. If an anomaly is identified, pouring control program 104 signals dispenser 110 to halt pouring. If no anomaly is identified, pouring control program 104 checks if the filling processing is complete. When the filling processing is complete, pouring control program 104 notifies user 101 that the filling process is complete via display 118.

Figure 2:
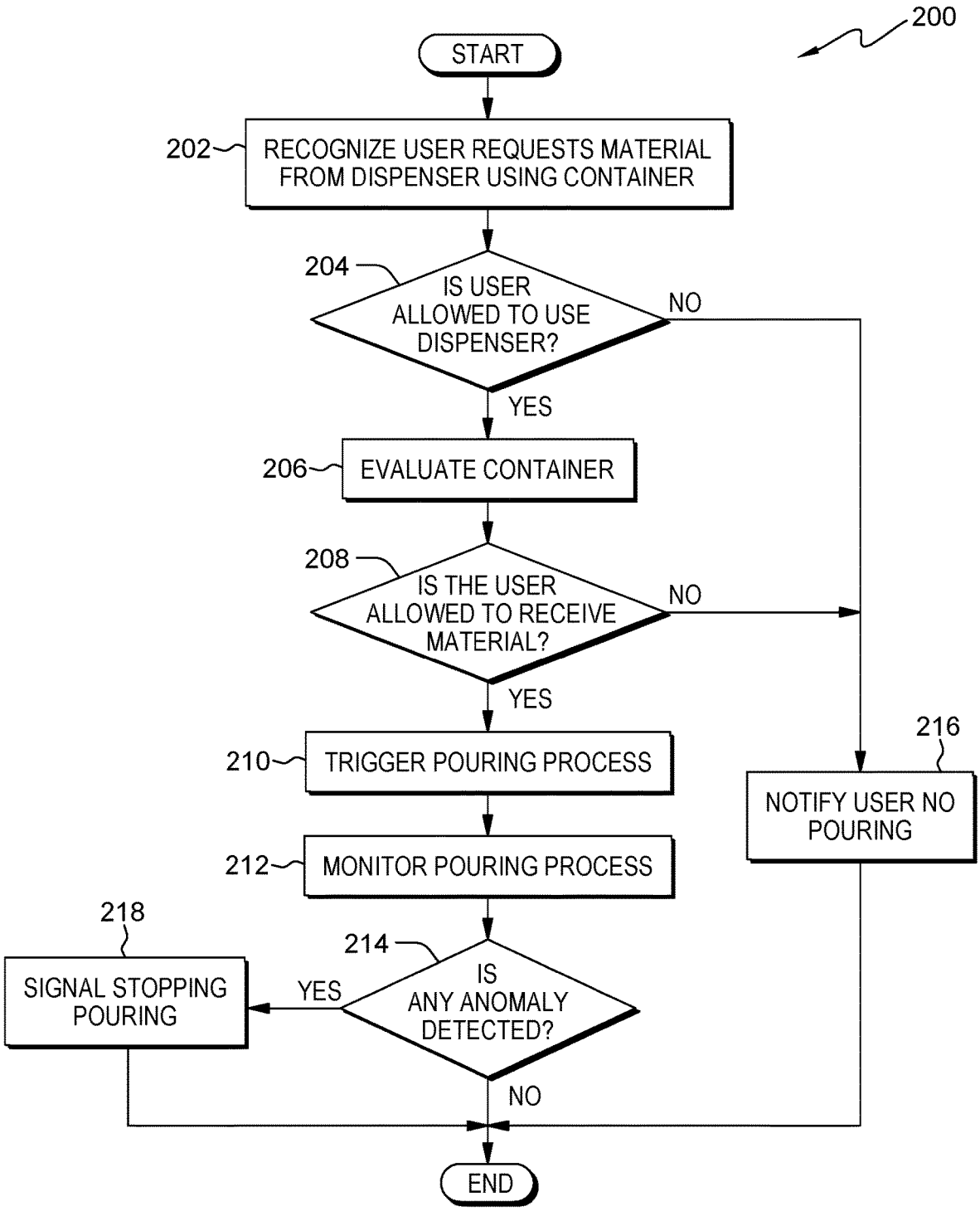
FIG. 2 is a flowchart depicting operational steps of a pouring control program within a computing device of FIG. 1, in accordance with an embodiment of the present disclosure.

FIG. 2 is a flowchart 200 depicting operational steps of pouring control program 104 in accordance with an embodiment of the present disclosure.

Pouring control program 104 operates to recognize that user 101 requests material from dispenser 110 with container 116. Pouring control program 104 also operates to evaluate container 116 via sensor(s) 112. Pouring control program 104 operates to determine that user 101 is allowed to receive the material. Pouring control program 104 operates to trigger dispenser 110 to pour the material into container 116. Pouring control program 104 operates to monitor dispenser 110 pouring the material. Pouring control program 104 operates to determine that any anomaly is detected during pouring the material. In response to determining that an anomaly is detected during pouring the material, pouring control program 104 operates to signal dispenser 110 to stop the pouring.

In step 202, pouring control program 104 recognizes user 101 requests material from dispenser 110 with container 116. In an example, the user request may be recognized by dispenser 110 through one or more sensor(s) 112. In another example, the user request may be recognized when user 101 touches display 118.

In decision 204, pouring control program 104 determines whether user 101 is allowed to use dispenser 110. Pouring control program 104 may identify user 101 to use dispenser 110 through user identifier 120. User 101 can disable this feature or have to opt in to have their identification information be obtained. User 101 is in control of what type of information is going to be collected and aware of how that information is going to be used. User identification information is detected by user identifier 120 for user 101. User identification can be achieved by several different methods, including, but not limited to, user identity and password, digital fingerprint, face recognition, near field communication, and other suitable user identification method by user identifier. In another example, a fingerprint reader may be used as another embodiment to user identification and authentication for using dispenser 110.

Pouring control program 104 may check the recognized user identification against a list of valid users within database 106. If user 101 is not in the list of valid users and is not allowed to use dispenser 110 (decision 204, "NO" branch), pouring control program 104 signals dispenser 110 not to provide material options for user 101 and notifies user not be allowed to use dispenser 110 in step 216. For example, display 118 may show a message notifying user 101 that user 101 is not allowed to use dispenser 110. If user 101 is in the list of valid users and is allowed to use dispenser 110 (decision 204, "YES" branch), pouring control program 104 moves to step 206.

In step 206, pouring control program 104 evaluates container 116 via one or more sensor(s) 112. Pouring control program 104 may evaluate container 116 by ascertaining characteristics of container 116 including size, volume, component, and condition of container 116. In an example, the evaluation of container 116 may be performed by one or more sensor(s) 112, including, but not limited to, an infrared dot projector, an infrared camera, an ultrasonic sensor, and a weight scale. For example, the infrared dot projector may project infrared dots over the surface of container 116. The infrared camera may capture the surface with the infrared dots. Pouring control program 104 may create a digital version of container 116. Pouring control program 104 may calculate the volume of container 116, and the amount of material that can be poured into container 116 without spilling. Pouring control program 104 may identify possible holes or cracks in container 116, that could cause material (e.g., liquid) to spill, or affect user's 101 ability to use container 116 after container 116 is filled. The ultrasonic sensor and the infrared camera can be used to evaluate the container's 116 component and thickness, in order to decide what types of material can be poured into container 116, without compromising the structure of container 116, nor compromising the safety of user 101.

If user authentication is successful, pouring control program 104 retrieves a list of material allowed for user 101. Pouring control program 104 may indicate dispenser 110 for ingredients available to create the requested material. User 101 can select the material from the options available. In one or more embodiments, pouring control program 104 checks if the material requested is allowed to the type of container 116 put by user 101. Pouring control program 104 evaluates, for example, the component and thickness of container 116, and the properties of the material to be poured, including, but not limited to, temperature, corrosiveness, and chemical properties of container 116. In decision 208, pouring control program 104 determines whether user 101 is allowed to receive the requested material by user 101 from dispenser 110. If pouring control program 104 determines that the requested material is not allowed for user 101 (decision 208, "NO" branch), pouring control program 104 notifies user the requested material is not allowed for user 101 in step 216. For example, display 118 may show a message notifying user 101 that the requested material is not allowed for user 101. If pouring control program 104 determines that the requested material is allowed for user 101 (decision 208, "YES" branch), pouring control program 104 moves to step 210.

In step 210, pouring control program 104 triggers the pouring process for dispenser 110 to pour the requested material into container 116 for user 101. If pouring control program 104 determines container 116 fails to match the requirements to receive the material from dispenser 110, display 118 displays a warning message to user 101, identifying the reason why the filling process cannot continue. If the required conditions for container 116 to receive the material user 101 has requested are met, dispenser 110 starts pouring the material into container 116. In step 212, during the pouring process, pouring control program 104 monitors container 116 and the material being poured through sensors 112, identifying situations that can compromise the filling process, or a user safety (e.g., over pouring). Pouring control program 104 may monitor through sensors 112 (e.g., an infrared camera and an ultrasonic sensor) to identify cracks, holes, and or deformations of container 116. At the same time, pouring control program 104 may monitor through sensors 112 (e.g., a weight sensor) to identify any leakage not identified by other sensors, or if container 116 is removed during the filling process. Any errors in the filling process may be logged to database 106 to prevent same or similar conditions that have resulted in error. The filling process is halted when an error happens during the filling process. After the filling process is complete, pouring control program 104 may notify user 101 by display 118 showing a notification message. User 101 can remove container 116 from dispenser 110 when the filling process is complete.

In one or more embodiments, pouring control program 104 may monitor container 116 and control the pouring through thermal monitoring by sensors 112. For example, pouring control program 104 may extract the three-dimensional information of container 116 and determine the surface border of container 116. During the pouring process, pouring control program 104 may use sensors 112 to monitor and identify variances to the thermal changes of container 116. As the material (e.g., liquid) is poured into container 116, the temperature difference between the liquid and container 116 results in a change in the surface temperature of container 116. This variance results in different wavelengths that will be captured by sensors 112 (e.g., infrared cameras or detectors) to determine the liquid level inside container 116. Once the infrared detectors detect the liquid has achieved the desired level, pouring control program 104 signals dispenser 110 to stop filling container 116.

In decision 214, pouring control program 104 determines whether any anomaly is detected during pouring the material from dispenser 110 into container 116. If pouring control program 104 determines that an anomaly is detected during the pouring process (decision 208, "YES" branch), pouring control program 104 signals dispenser 110 to stop the pouring. As discussed above, pouring control program 104 may trigger to monitor and detect anomalies after the pouring process is started. In an example, the surface of container 116 may be evenly heated for a period of time. A typical source of heat can be the power of a light. The heat may last for milliseconds of a high thermal conductivity of the material to few seconds for low material conductivity. The thermal pulse delivered in the first stage propagates inside container 116 and is reflected by inclusions or material with thermal properties that container 116 contains. During propagation of the excited jumps, sensors 112 (e.g., the infrared camera) scan the surface of container 116, recording a sequence of images of container 116. The sequence of images may represent the thermal distribution of the inspected surface as a function of time. The sequence of images can have, for example, 200-500 recordings. Pouring control program 104 analyzes the sequence of images to extract shape defects, depth, edge defects and surface of container 116. In general, the analysis can be explained as defects, inclusions or removal of material properties from container 116. While the thermal pulse is propagated, the temperature rates decay in defective or undamaged areas of container 116, identifying that there is a difference. If an anomaly is identified, pouring control program 104 signals dispenser 110 to halt pouring. If no anomaly is identified, pouring control program 104 checks if the filling processing is complete. When the filling processing is complete, pouring control program 104 notifies user 101 that the filling process is complete via display 118.

Figure 3:
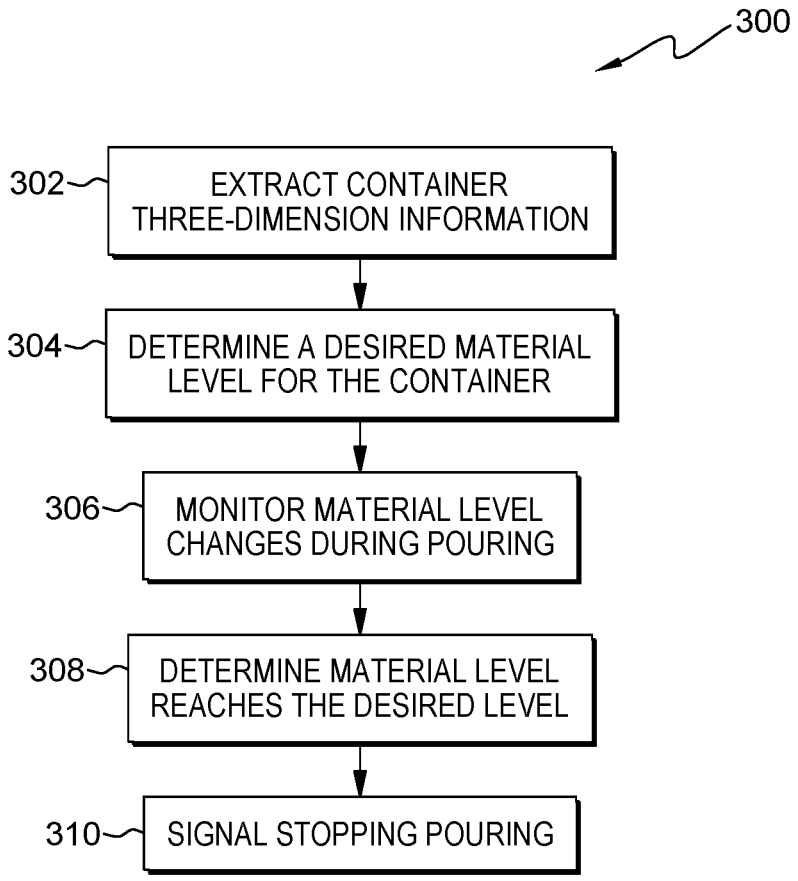
FIG. 3 is a flowchart depicting operational steps of the pouring control program for monitoring a pouring process, included in the computing device of FIG. 1, in accordance with an embodiment of the present disclosure.

FIG. 3 is a flowchart 300 depicting operational steps of pouring control program 104 for monitoring a pouring process in accordance with an embodiment of the present disclosure.

Pouring control program 104 operates to extract the three-dimension information of container 116. Pouring control program 104 also operates to determine a desired material level for container 116 when user 101 puts container 116 to receive material from dispenser 110. Pouring control program 104 operates to monitor material level changes during the pouring for container 116. Pouring control program 104 operates to determine that the material level reaches the desired material level of container 116. Pouring control program 104 operates to signal dispenser 110 to stop the pouring when the material level reaches the desired material level of container 116.

In one or more embodiments, pouring control program 104 may monitor container 116 and control the pouring through thermal monitoring by sensors 112. In step 302, pouring control program 104 extracts the three-dimensional information of container 116 and determines the surface border of container 116. In step 304, pouring control program 104 determines a desired level of material for container 116 based on the extracted three-dimension information and the detected surface border information of container 116. During the pouring process, pouring control program 104 may use sensors 112 (e.g., infrared cameras or detectors) to monitor and identify variances to the thermal changes of container 116 in step 306. As the material (e.g., liquid) is poured into container 116, the temperature difference between the liquid and container 116 results in a change in the surface temperature of container 116. This variance results in different wavelengths that will be captured by sensors 112 (e.g., infrared cameras or detectors) to determine the material (e.g. liquid) level inside container 116. Once the infrared detectors detect the material (e.g., liquid) have achieved the desired level in step 308, pouring control program 104 signals dispenser 110 to stop filling container 116 in step 310.

Figure 4:
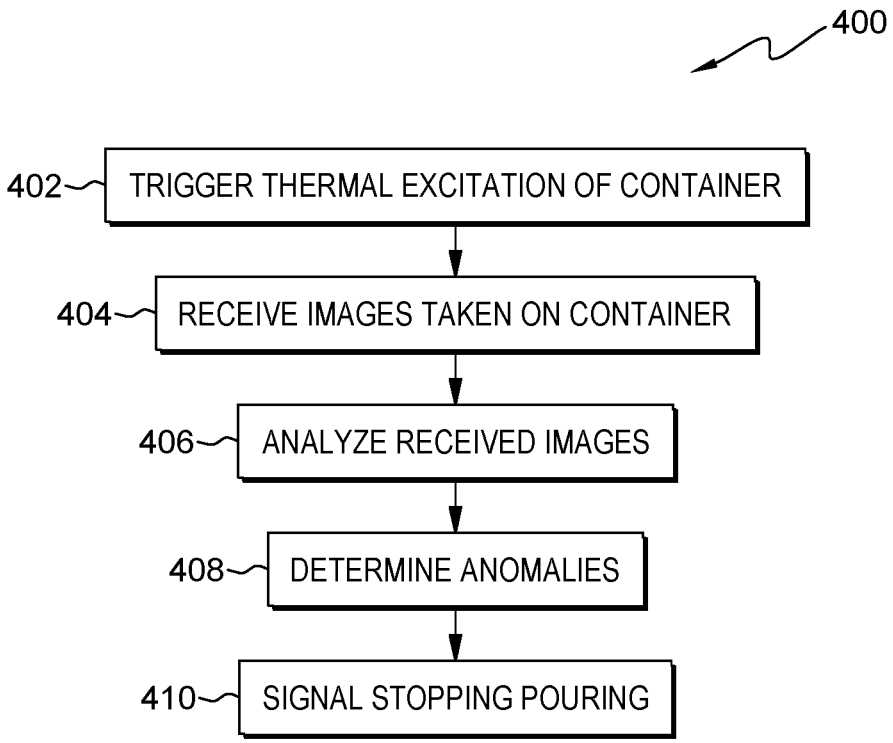
FIG. 4 is a flowchart 400 depicting operational steps of the pouring control program 104 for detecting anomalies during the pouring process, included in the computing device of FIG. 1, in accordance with an embodiment of the present disclosure.

FIG. 4 is a flowchart 400 depicting operational steps of pouring control program 104 for detecting anomalies during a pouring process in accordance with an embodiment of the present disclosure.

Pouring control program 104 operates to trigger thermal excitation of container 116 via one or more sensors 112. Pouring control program 104 also operates to receive images taken by one or more sensors 112 on container 116. Pouring control program 104 operates to analyze the received images. Pouring control program 104 operates to determine any anomaly based on the analysis of the received images. Pouring control program 104 operates to signal dispenser 110 to stop the pouring.

In one or more embodiments, pouring control program 104 determines whether any anomaly is detected during the pouring process from dispenser 110 to container 116. In response to determining that an anomaly is detected during the pouring process, pouring control program 104 signals dispenser 110 to stop the pouring. Pouring control program 104 may trigger to monitor and detect anomalies after the pouring process is started. In step 402, pouring control program 104 triggers thermal excitation of container 116 via one or more sensors 112. A typical source of heat can be the power of a light. The inspected surface of container 116 may evenly be heated for a period of time. The heat may last for milliseconds of a high thermal conductivity of the material to few seconds for low material conductivity. The thermal pulse delivered in the first stage propagates inside container 116 and is reflected by inclusions or material with thermal properties that container 116 contains. During propagation of the excited jumps, sensors 112 (e.g., the infrared camera) scan the front surface, recording a sequence of images of container 116. In step 404, pouring control program 104 receives images taken by one or more sensors 112 on container 116, for example, by an infrared camera. The sequence of images may represent the thermal distribution of the inspected surface as a function of time. The sequence of images can have, for example, 200-500 recordings. In step 406, pouring control program 104 analyzes the sequence of images to extract shape defects, depth, edge defects and surface of container 116. In general, the analysis can be explained as defects, inclusions or removal of material properties from container 116. While the thermal pulse is propagated, the temperature rates decay in defective or undamaged areas of the vessel, identifying that there is a difference. In step 408, when an anomaly is identified, pouring control program 104 signals dispenser 110 to stopping pouring in step 410. If no anomaly is identified, pouring control program 104 checks if the filling processing is complete. When the filling processing is complete, pouring control program 104 notifies user 101 that the filling process is complete via display 118.

Figure 5:
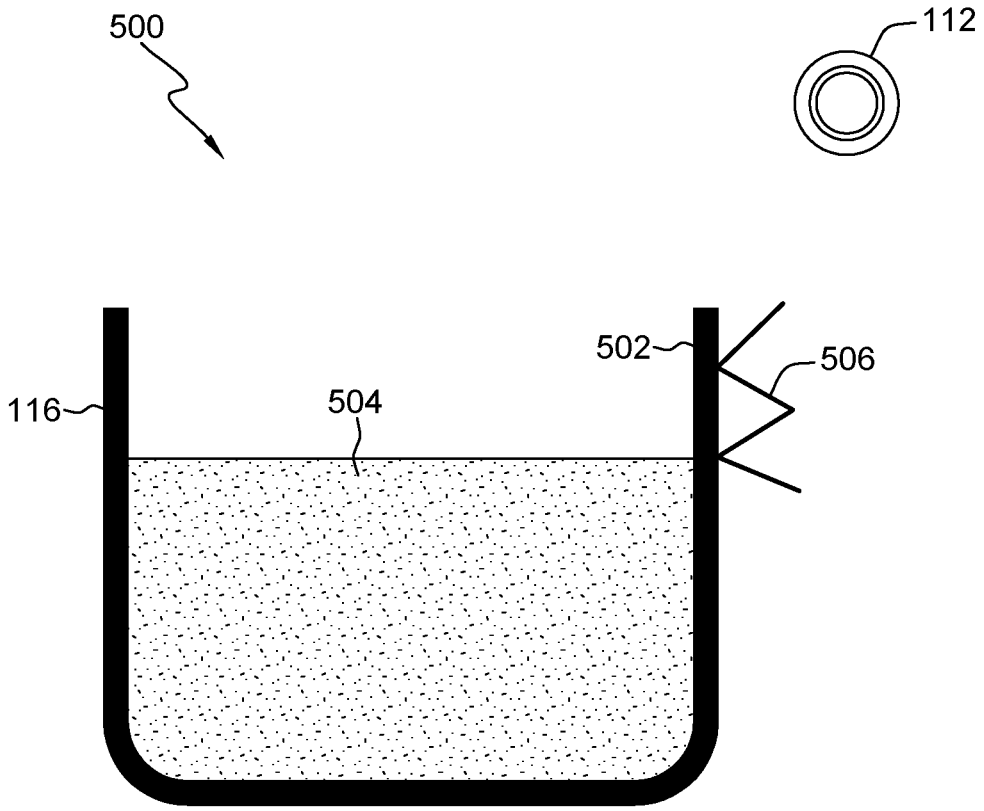
FIG. 5 illustrates an example pouring detection of the pouring control program 104 within the computing device of FIG. 1, in accordance with an embodiment of the present disclosure.

FIG. 5 illustrates an example pouring detection 500 of pouring control program 104 in accordance with an embodiment of the present disclosure.

Pouring control program 104 may monitor and control through thermal monitoring by sensors 112. Pouring control program 104 extracts the three-dimensional information of container 116 and determines the surface border 502 of container 116. Pouring control program 104 determines a desired level of liquid 504 for container 116 based on the extracted three-dimension information and the detected surface border 502 information of container 116. During the pouring process, pouring control program 104 may use sensors 112 (e.g., infrared cameras or detectors) to monitor and identify variances to the thermal changes of container 116. As the liquid 504 is poured into container 116, the temperature difference between the liquid 504 and container 116 results in a change in the surface temperature of container 116. This variance results in different wavelengths 506 that are captured by sensors 112 (e.g., infrared cameras or detectors) to determine the liquid 504 level inside container 116. Once the infrared detectors detect the liquid 504 has achieved the desired level, pouring control program 104 signals dispenser 110 to stop filling container 116.

Figure 6:
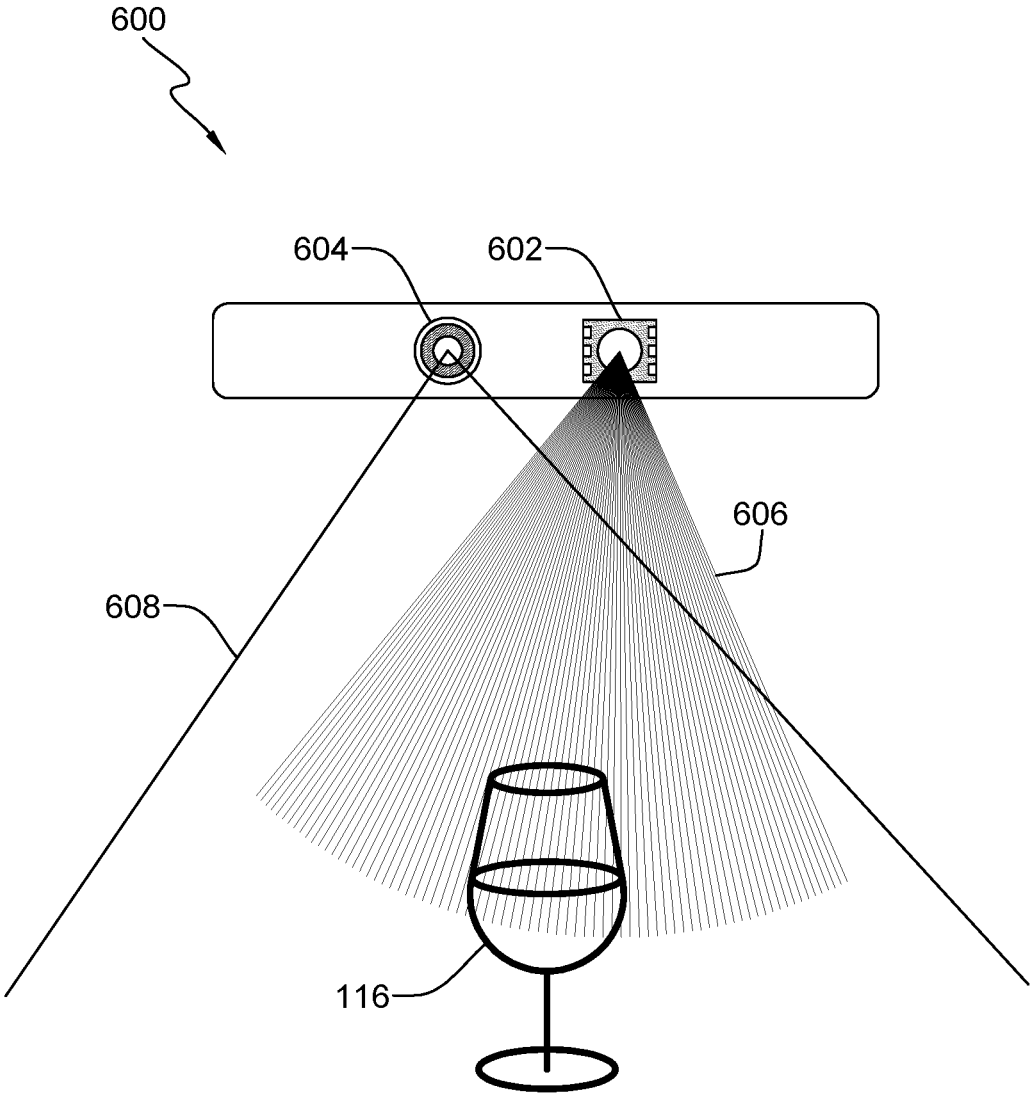
FIG. 6 illustrates an example infrared container detection 600 of the pouring control program within the computing device of FIG. 1, in accordance with an embodiment of the present disclosure.

FIG. 6 illustrates an example infrared container detection 600 of pouring control program 104 in accordance with an embodiment of the present disclosure.

In the example embodiment of FIG. 6, container 116, for example, a glass, is put into dispenser 110 under infrared projector 602 and infrared camera 604. Infrared projector 602 and infrared camera 604 are example sensors 112 as described in FIG. 1. Infrared projector 602 projects infrared dots 606 towards container 116. Infrared camera 604 reads the projected infrared dots 608. For example, infrared camera 604 may scan container 116, recording a sequence of images of container 116. The sequence of images may represent the thermal distribution of the inspected surface as a function of time. The sequence of images can have, for example, 200-500 recordings. Pouring control program 104 analyzes the sequence of images to extract shape defects, depth, edge defects and surface of container 116. In general, the analysis can be explained as defects, inclusions or removal of material properties from container 116. While the thermal pulse is propagated, the temperature rates decay in defective or undamaged areas of the vessel, identifying that there is a difference. When an anomaly is identified, pouring control program 104 signals dispenser 110 to stopping pouring. If no anomaly is identified, pouring control program 104 checks if the filling processing is complete. When the filling processing is complete, pouring control program 104 notifies user 101 that the filling process is complete via display 118.

Figure 7:
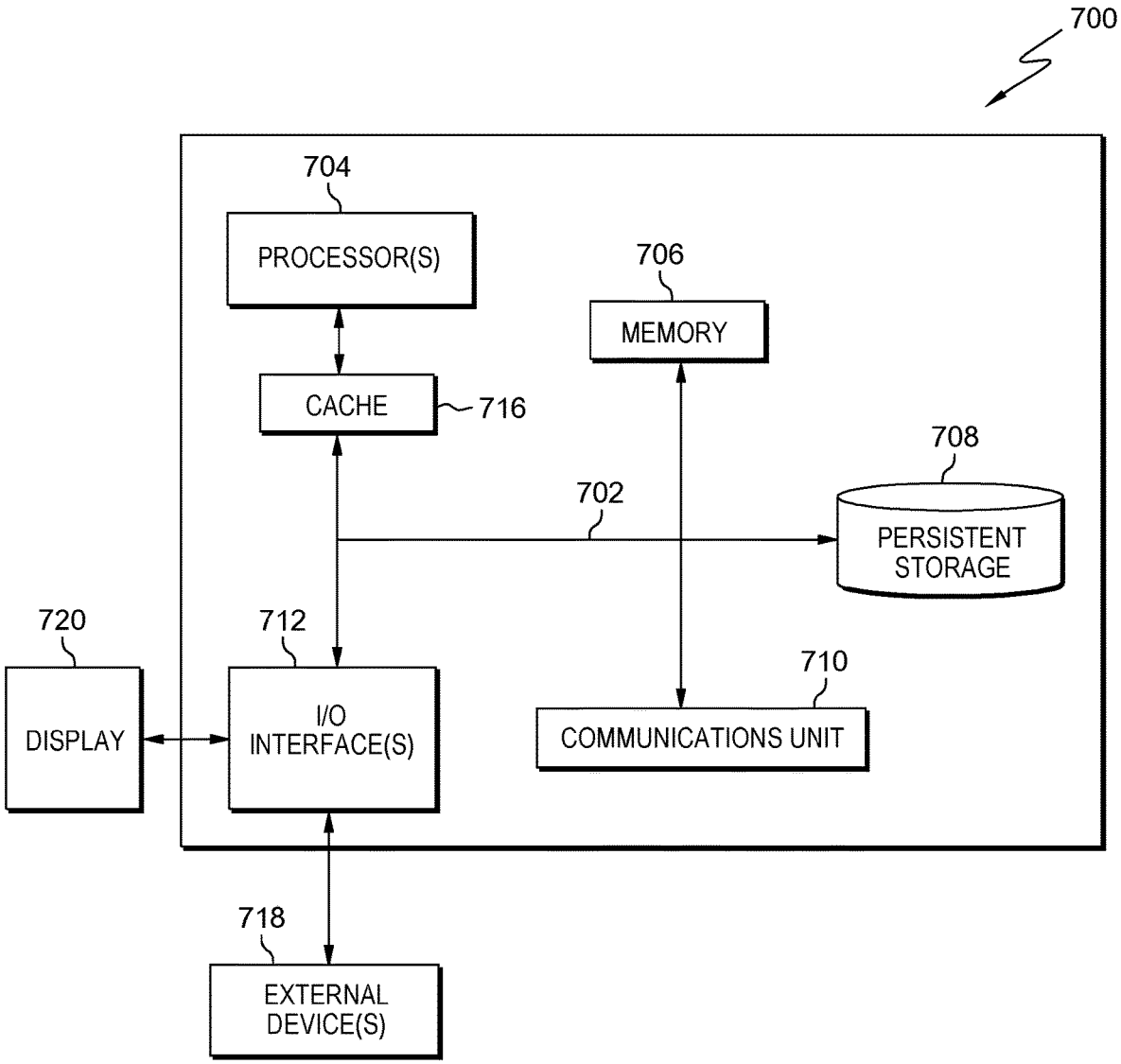
FIG. 7 is a block diagram of components of the computing device of FIG. 1, in accordance with an embodiment of the present disclosure.

FIG. 7 depicts a block diagram 700 of components of computing device 102 in accordance with an illustrative embodiment of the present disclosure. It should be appreciated that FIG. 7 provides only an illustration of one implementation and does not imply any limitations with regard to the environments in which different embodiments may be implemented. Many modifications to the depicted environment may be made.

Computing device 102 may include communications fabric 702, which provides communications between cache 716, memory 706, persistent storage 708, communications unit 710, and input/output (I/O) interface(s) 712. Communications fabric 702 can be implemented with any architecture designed for passing data and/or control information between processors (such as microprocessors, communications and network processors, etc.), system memory, peripheral devices, and any other hardware components within a system. For example, communications fabric 702 can be implemented with one or more buses or a crossbar switch.

Memory 706 and persistent storage 708 are computer readable storage media. In this embodiment, memory 706 includes random access memory (RAM). In general, memory 706 can include any suitable volatile or non-volatile computer readable storage media. Cache 716 is a fast memory that enhances the performance of computer processor(s) 704 by holding recently accessed data, and data near accessed data, from memory 706.

Pouring control program 104 may be stored in persistent storage 708 and in memory 706 for execution by one or more of the respective computer processors 704 via cache 716. In an embodiment, persistent storage 708 includes a magnetic hard disk drive. Alternatively, or in addition to a magnetic hard disk drive, persistent storage 708 can include a solid state hard drive, a semiconductor storage device, read-only memory (ROM), erasable programmable read-only memory (EPROM), flash memory, or any other computer readable storage media that is capable of storing program instructions or digital information.

The media used by persistent storage 708 may also be removable. For example, a removable hard drive may be used for persistent storage 708. Other examples include optical and magnetic disks, thumb drives, and smart cards that are inserted into a drive for transfer onto another computer readable storage medium that is also part of persistent storage 708.

Communications unit 710, in these examples, provides for communications with other data processing systems or devices. In these examples, communications unit 710 includes one or more network interface cards. Communications unit 710 may provide communications through the use of either or both physical and wireless communications links. Pouring control program 104 may be downloaded to persistent storage 708 through communications unit 710.

I/O interface(s) 712 allows for input and output of data with other devices that may be connected to computing device 102. For example, I/O interface 712 may provide a connection to external devices 718 such as a keyboard, keypad, a touch screen, and/or some other suitable input device. External devices 718 can also include portable computer readable storage media such as, for example, thumb drives, portable optical or magnetic disks, and memory cards. Software and data used to practice embodiments of the present invention, e.g., pouring control program 104, can be stored on such portable computer readable storage media and can be loaded onto persistent storage 708 via I/O interface(s) 712. I/O interface(s) 712 also connect to display 720.

Display 720 provides a mechanism to display data to a user and may be, for example, a computer monitor.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Python, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be accomplished as one step, executed concurrently, substantially concurrently, in a partially or wholly temporally overlapping manner, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the invention. The terminology used herein was chosen to best explain the principles of the embodiment, the practical application or technical improvement over technologies found in the marketplace, or to enable others of ordinary skill in the art to understand the embodiments disclosed herein.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Figure 8:
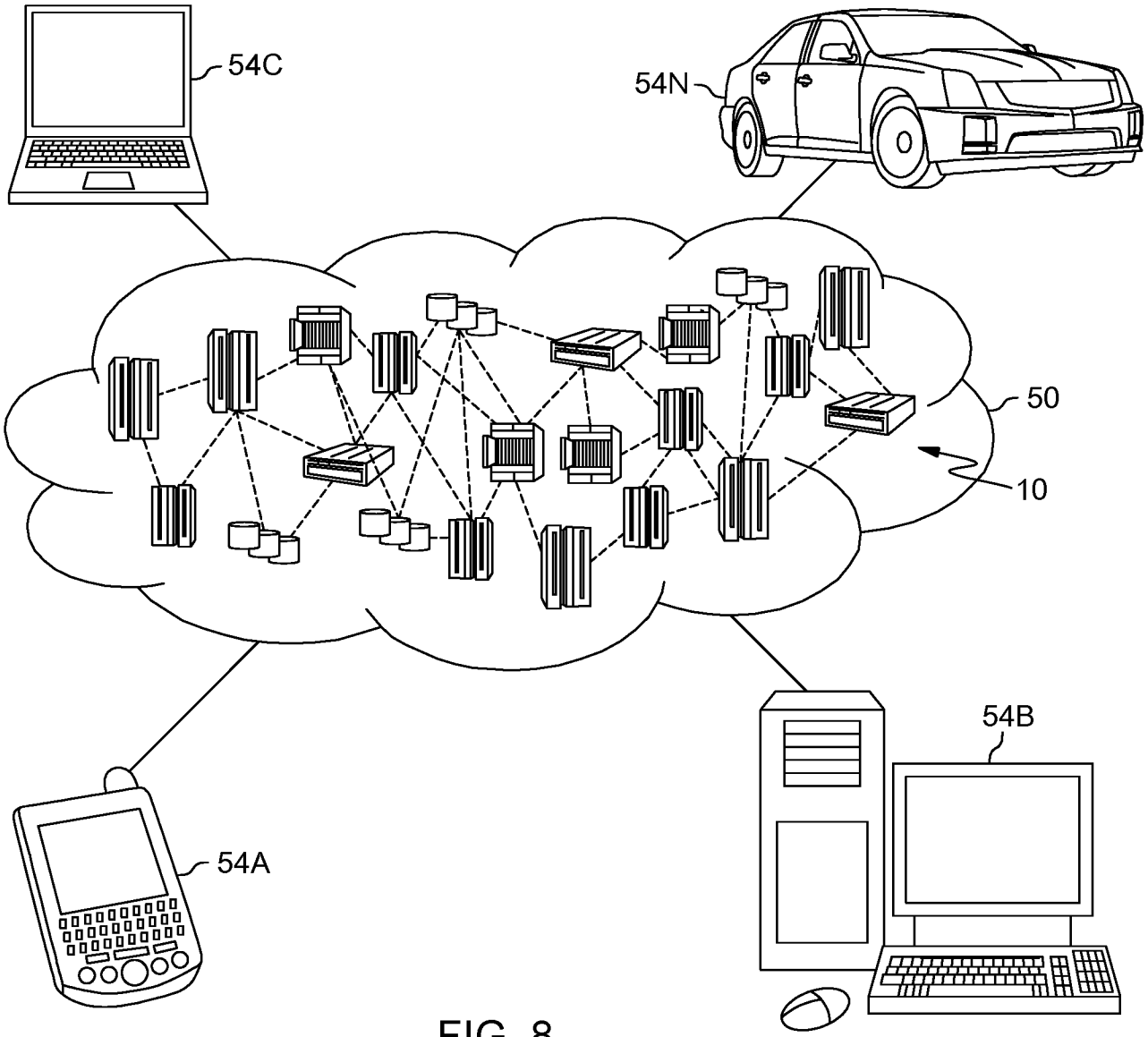
FIG. 8 depicts an embodiment of a cloud computing environment in accordance with the present disclosure.

Referring now to FIG. 8, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 8 are intended to be illustrative only and that computing nodes 10 and cloud computing environment 50 can communicate with any type of computerized device over any type of network and/or network addressable connection (e.g., using a web browser).

Figure 9:
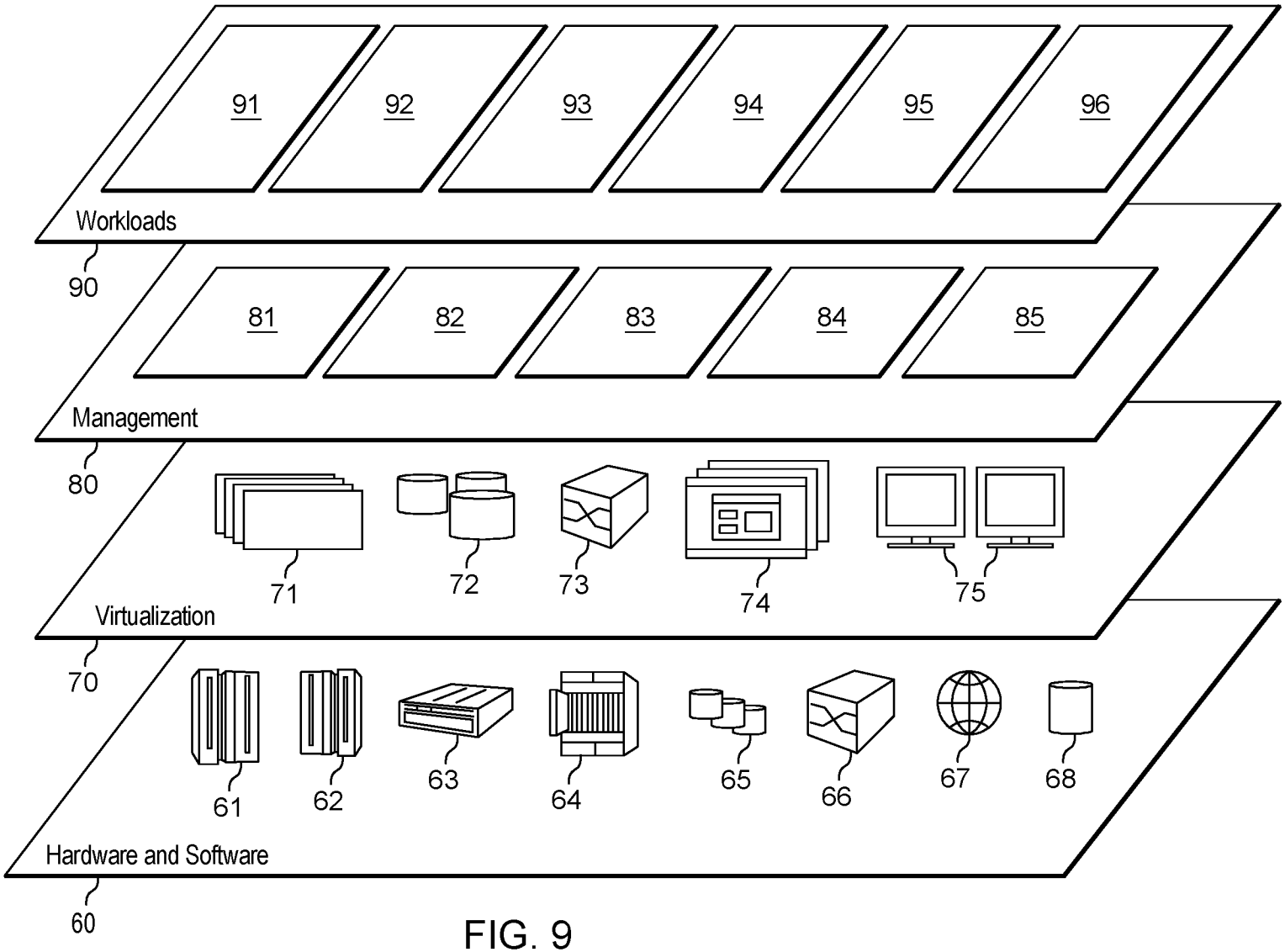
FIG. 9 depicts an embodiment of abstraction model layers of a cloud computing environment, in accordance with the present disclosure.

Referring now to FIG. 9, a set of functional abstraction layers provided by cloud computing environment 50 (FIG. 8) is shown. It should be understood in advance that the components, layers, and functions shown in FIG. 6 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and module 96 including, for example, pouring control program 104 as described above with respect to pouring control environment 100.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A computer-implemented method comprising:

recognizing, by one or more processors, that a user requests material from a dispenser with a container;

evaluating, by one or more processors, the container via one or more sensors;

determining, by one or more processors, that the user is allowed to receive the material;

in response to determining that the user is allowed to receive the material, triggering, by one or more processors, the dispenser to pour the material into the container;

monitoring, by one or more processors, the dispenser pouring the material;

extracting, by one or more processors, three-dimension information of the container;

determining, by one or more processors, a surface border of the container;

determining, by one or more processors, a desired material level for the container based on the extracted three-dimension information and the detected surface border information of the container;

monitoring, by one or more processors, material level changes during the pouring by identifying variances to thermal changes of the container;

determining, by one or more processors, that the material level reaches the desired material level based on the variances to the thermal changes of the container;

in response to determining that the material level reaches the desired material level, signaling, by one or more processors, the dispenser to stop the pouring;

determining, by one or more processors, that an anomaly is detected during pouring the material; and in response to determining that the anomaly is detected during pouring the material, signaling, by one or more processors, the dispenser to stop the pouring.

2. The computer-implemented method of claim 1, wherein evaluating the container includes ascertaining characteristics of the container including size, volume, component, and condition of the container.

3. The computer-implemented method of claim 1, wherein the one or more sensors include a camera, a projector, an ultrasonic sensor, and a weight sensor.

4. The computer-implemented method of claim 1, wherein determining that the user is allowed to receive the material includes identifying the user by a way selected from the group consisting of: a user password, a digital fingerprint, a facial recognition, a near-field communication, and a biometric recognition.

5. The computer-implemented method of claim 1, wherein determining that the anomaly is detected during pouring the material includes:

triggering, by one or more processors, thermal excitation of the container via the one or more sensors, receiving, by one or more processors, images taken on the container, analyzing, by one or more processors, the received images, and determining, by one or more processors, the anomaly based on the analysis of the received images.

6. The computer-implemented method of claim 1, wherein the material is liquid.

7. A computer program product comprising:

one or more computer readable storage media, and program instructions collectively stored on the one or more computer readable storage media, the program instructions comprising:

program instructions to recognize that a user requests material from a dispenser with a container;

program instructions to evaluate the container via one or more sensors;

program instructions to determine that the user is allowed to receive the material;

program instructions to, in response to determining that the user is allowed to receive the material, trigger the dispenser to pour the material into the container;

program instructions to monitor the dispenser pouring the material;

program instructions to extract three-dimension information of the container;

program instructions to determine a surface border of the container;

program instructions to determine a desired material level for the container based on the extracted three-dimension information and the detected surface border information of the container;

program instructions to monitor material level changes during the pouring by identifying variances to thermal changes of the container;

program instructions to determine that the material level reaches the desired material level based on the variances to the thermal changes of the container;

program instructions to, in response to determining that the material level reaches the desired material level, signal the dispenser to stop the pouring;

program instructions to determine that an anomaly is detected during pouring the material; and program instructions to, in response to determining that the anomaly is detected during pouring the material, signal the dispenser to stop the pouring.

8. The computer program product of claim 7, wherein program instructions to evaluate the container include program instructions to ascertain characteristics of the container including size, volume, component, and condition of the container.

9. The computer program product of claim 7, wherein the one or more sensors include a camera, a projector, an ultrasonic sensor, and a weight sensor.

10. The computer program product of claim 7, wherein program instructions to determine that the user is allowed to receive the material include program instructions to identify the user by a way selected from the group consisting of: a user password, a digital fingerprint, a facial recognition, a near-field communication, and a biometric recognition.

11. The computer program product of claim 7, wherein program instructions to determine that the anomaly is detected during pouring the material include:

program instructions to trigger thermal excitation of the container via the one or more sensors, program instructions to receive images taken on the container, program instructions to analyze the received images, and program instructions to determine the anomaly based on the analysis of the received images.

12. The computer program product of claim 7, wherein the material is liquid.

13. A computer system comprising:

one or more computer processors, one or more computer readable storage media, and program instructions stored on the one or more computer readable storage media for execution by at least one of the one or more computer processors, the program instructions comprising:

program instructions to recognize that a user requests material from a dispenser with a container;

program instructions to evaluate the container via one or more sensors;

program instructions to determine that the user is allowed to receive the material;

program instructions to, in response to determining that the user is allowed to receive the material, trigger the dispenser to pour the material into the container;

program instructions to monitor the dispenser pouring the material;

program instructions to extract three-dimension information of the container;

program instructions to determine a surface border of the container;

program instructions to determine a desired material level for the container based on the extracted three-dimension information and the detected surface border information of the container;

program instructions to monitor material level changes during the pouring by identifying variances to thermal changes of the container;

program instructions to determine that the material level reaches the desired material level based on the variances to the thermal changes of the container;

program instructions to, in response to determining that the material level reaches the desired material level, signal the dispenser to stop the pouring;

program instructions to determine that an anomaly is detected during pouring the material; and program instructions to, in response to determining that the anomaly is detected during pouring the material, signal the dispenser to stop the pouring.

14. The computer system of claim 13, wherein program instructions to evaluate the container include program instructions to ascertain characteristics of the container including size, volume, component, and condition of the container.

15. The computer system of claim 13, wherein the one or more sensors include a camera, a projector, an ultrasonic sensor, and a weight sensor.

16. The computer system of claim 13, wherein program instructions to determine that the user is allowed to receive the material include program instructions to identify the user by a way selected from the group consisting of: a user password, a digital fingerprint, a facial recognition, a near-field communication, and a biometric recognition.

17. The computer system of claim 13, wherein program instructions to determine that the anomaly is detected during pouring the material include:

program instructions to trigger thermal excitation of the container via the one or more sensors, program instructions to receive images taken on the container, program instructions to analyze the received images, and program instructions to determine the anomaly based on the analysis of the received images.

* * * * *